US005755112A

United States Patent [19]

Kang

[11] Patent Number: 5,755,112

[45] Date of Patent: May 26, 1998

[54] REFRIGERATOR WITH A SPRIAL COOL AIR DISPERSING DEVICE

[75] Inventor: Tae Gil Kang, Suwon, Rep. of Korea

[73] Assignee: Samsung Electronics Co., Ltd., Suwon, Rep. of Korea

[21] Appl. No.: 809,823

[22] PCT Filed: Aug. 19, 1996

[86] PCT No.: PCT/KR96/00138

§ 371 Date: May 29, 1997

§ 102(e) Date: May 29, 1997

[87] PCT Pub. No.: WO97/07371

PCT Pub. Date: Feb. 27, 1997

[30] Foreign Application Priority Data

Aug. 19, 1995 [KR] Rep. of Korea ..... 1995/21429 U

[51] Int. Cl.[6] ..... F25D 17/04

[52] U.S. Cl. ..... 62/407; 62/440; 62/419

[58] Field of Search ..... 62/407, 408, 413, 62/418, 419, 426, 186; 454/284

[56] References Cited

U.S. PATENT DOCUMENTS 3,455,119 7/1969 Bright ..... 62/408

4,296,611 10/1981 Griffin et al. ..... 62/408

FOREIGN PATENT DOCUMENTS

95/33167 12/1995 WIPO .

*Primary Examiner*—John M. Sollecito

*Attorney, Agent, or Firm*—Burns, Doane, Swecker & Mathis, L.L.P.

[57] ABSTRACT

A refrigerator includes a main body (64) housing a fresh food compartment (63), and a cool air duct (131) provided in a wall of the fresh food compartment and having cool air discharging openings (111) opened toward the fresh food compartment (63) to supply a cool air from an evaporator (72b) into the fresh food compartment. The refrigerator comprises a rotary shaft (85); a driving means (125) for rotating the rotary shaft; and cool air dispersing wings (81) mounted spirally on the rotary shaft (85) near the cool air discharging openings (111) to deviate the discharge angle of the cool air blown into the fresh food compartment (63) through the cool air discharging openings. A cool air dispersing device (80) equipped with such spiral cool air dispersing wings (81) realizes an even refrigeration of the fresh food compartment (63) in the left, right, up and down directions. Furthermore a concentrated cooling of one specific region is also made possible by the fixable angular position of the cool air dispersion wings (81).

5 Claims, 13 Drawing Sheets

REFRIGERATOR WITH A SPRIAL COOL AIR DISPERSING DEVICE

TECHNICAL FIELD

The present invention relates to a refrigerator, more specifically to a refrigerator including a main body housing a fresh food compartment, and a cool air duct provided in a wall of the fresh food compartment and having cool air discharge openings opened toward the fresh food compartment to supply a cool air from an evaporator into the fresh food compartment.

BACKGROUND ART

As described in FIG. 1, a conventional refrigerator has a thermally insulated main body 4 housing a freezing compartment 2 and a fresh food compartment 3 separated with each other by a partitioning wall 1, as well as a freezing compartment door 6 and a fresh food compartment door 7 which open/close the freezing compartment 2 and the fresh food compartment 3 respectively. In the main body 4 of the refrigerator is installed a refrigeration system consisting of a compressor 11, a condenser(not shown), an evaporator **12*a* for the freezing compartment 2 and an evaporator 12*b* for the fresh food compartment 3. A cool air produced at each evaporator 12*a*, 12*b* is directed toward the freezing compartment 2 and fresh food compartment 3 by means of the freezing compartment fan 13*a* or the fresh food compartment fan 13*b***.

In the back wall of the fresh food compartment 3 is disposed a cool air duct 15 guiding the cool air from the fresh food compartment fan **13*b*. The cool air duct 15 has cool air discharging openings 16 facing the interior of the fresh food compartment 3 through which the cool air is provided to the compartment 3. A control damper 19 closing/opening the entrance of the cool air duct 15 is provided at the entrance of the cool air duct 15 in order to control the amount of cool air blown into the fresh food compartment 3**.

In the typical refrigerators, the cool air for the fresh food compartment 3 is generally delivered in a so-called shelf-by-shelf fashion as illustrated in FIG. 2. In a shelf-by-shelf cooling method, the fresh food compartment 3 is stratified by means of shelves 8 into several sub-compartments, and the vertically arranged cool air discharging openings 16 are associated to the sub-compartments to provide the cool air to the respective corresponding sub-compartment.

However, the refrigerator adopting the above shelf-by-shelf cooling method are burdened with a problem of an uneven refrigeration in the fresh food compartment 3, due to a temperature difference between regions of the fresh food compartment 3. Since the cool air is blown into the compartment 3 only in the direction toward which the discharging openings 16 is facing, there is bound to exist a region within the compartment 3 receiving more cool air or less than others. Furthermore such a cooling method does not allow the flexibility to concentrate the cool air into a specific region when there is a necessity to have a region cooler than others.

A so-called tri-dimensional refrigerator has been recently conceived to overcome the forementioned shortcoming of the shelf-by-shelf cooling method. As illustrated in FIG. 3, in such a method, a number of cool air discharging openings 16' are located not only on the back wall but also on the side walls of the fresh food compartment 3 allowing the delivery of the cool air from three sides.

Such a tri-dimensional cooling method, despite an improved uniform distribution of cool air in the fresh food compartment 3 however, does not permit the cool air to be fully dispersed in the compartment 3 as the discharge of the cool air is effectuated only in fixed directions. Foodstuffs stored in a region where the cool air is mainly directed have a risk of being over-cooled. By contrast, foodstuffs scored in the corners may not be cooled sufficiently. Accordingly, in the method, there's a definite limit in maintaining the temperature even throughout the storage area. Furthermore, as in the case of the shelf-by-shelf cooling system, this method makes impossible to concentrate the cool air into a specific area, should there exist a necessity to do so. A further significant problem of the tri-dimensional cooling method is that a refrigerator equipped with such a system is expensive to produce (extra parts and extra manufacturing cost) as additional ducts need to be installed at the side walls of the fresh food compartment 3. Furthermore, such a refrigerator has yet another disadvantage of a reduced storing capacity as the walls need to be thicker. Moreover, the energy loss in the cool air flow becomes more significant.

The above mentioned problems become a real issue with today's trend of increasingly larger refrigerators. In high capacity refrigerators which necessitate larger dimensions, there is a definite limit in distributing the cool air evenly to all regions in the fresh food compartment 3. As illustrated in FIG. 1, since each cool air discharging opening 16 is formed perpendicularly to the direction of the flow of the cool air, the cool air coming from the evaporator **12*b* is not evenly distributed among the discharging openings 16. The lower the discharging opening 16*b* is, the more cool air is distributed to. As a consequence, a uniform distribution of cool air in the fresh food compartment 3** in a vertical direction can not be achieved, resulting in the over-cooling of the foodstuffs stored at the bottom, and under-cooling of those foodstuffs stored at the top.

In order to solve the forementioned problems, a refrigerator has been proposed in International Patent Publication WO 95/27178 by the applicant of this invention. The refrigerator is equipped with a cool air dispersing device which distributes the cool air from the cool air duct evenly to all regions of the fresh food compartment, as illustrated in FIGS. 4 to 7.

FIG. 4 is a side cross-sectional view of a refrigerator equipped with a cool air dispersing device, and FIG. 5 is a partially enlarged view of the refrigerator in FIG. 4. As in the conventional refrigerator of FIG. 1, the refrigerator consists of a main body 14, a compressor 31, evaporators **32*a*, 32*b* and fans 33*a*, 33*b*. In the rear wall of the fresh food compartment 23 is provided a cool air duct 34 through which the cool air from the fresh food compartment evaporator 32*b* flows down after being blown therein by the fresh food compartment fan 33*b*. Inside this cool air duct 34 is disposed a cool air dispersing device 40 in a vertical arrangement. In the rear wall of the fresh food compartment 23 are disposed a cool air discharging openings 36 through which the cool air from the cool air duct 34 is discharged into the fresh food compartment 23. The cool air dispersing device 40 guides the provided cool air into the fresh food compartment 23 through these cool air discharging openings 36. In the rear of the cool air duct 34 is disposed a circulation duct 28 connecting the fresh food compartment 23 and the fresh food compartment evaporator 32*b* in such a way that the circulation duct 28 is isolated from the cool air duct 34. The cool air, after cooling the fresh food compartment 23, is returned to the fresh food compartment evaporator 32*b* via the circulation duct 28**.

The cool air dispersing device 40, as illustrated in FIG. 6, is comprised of a rotary shaft 41, and a plurality of cool air dispersing wings 45. The rotary shaft 41 is installed at the surface of the rear wall of the fresh food compartment 23 in such a way as to allow it to rotate freely. To the upper part of the rotary shaft 41 is connected a driving motor 38 which enables the rotation of the shaft 41. The cool air dispersing wings 45 have a waved strip shape waved to a plane including the rotational axis of the rotary shaft 41. The wings 45 are distanced out from each other along the length of the shaft 41 and are disposed as to correspond to the positions of the cool air discharging openings 36. At the upper and lower end of each cool air dispersing wing 45 are disposed end discs 43 including upper and lower disc 43*a* and 43*b* respectively. Furthermore, between the discs 43*a* and 43*b* is disposed a middle disc 44 which bisects the cool air dispersing wing 45 into a first wing portion 45*a* and a second wing portion 45*b*. Each wing portion 45*a*, 45*b* is curved in such fashion as to have a an "S" shaped cross-section. Within a single cool air dispersing wing 45, the "S" shape of the upper and lower wing portions 45*a* and 45*b* are reversed to each other.

When the driving motor 38 rotates the rotary shaft 41 at low speed, the cool air supplied through the cool air duct 34 changes its direction of flow according to the curved surface of the cool air dispersing wings 45; and as depicted in FIG. 7, the cool air is blown into the fresh food compartment 23, dispersed to the left and right directions. An even distribution of the cool air in the right and the left side of the fresh food compartment 23 is achieved, and the cool air can be concentrated to one specific region by fixing the cool air dispersing wing's 45 facing direction by stopping the rotation of the rotary shaft 41. It is by such a cool air dispersing device 40 that an evenly distributed refrigeration or a concentrated refrigeration are realized in the fresh food compartment 23.

Although the above cool air dispersing device 40 allows the refrigerator to achieve an even distribution of the cool air in the horizontal direction, it does not allow an even distribution of the cool air in the vertical plane. In other words, the above cool air dispersing device do allow a left-right dispersion of the cool air, but do not allow an up-down dispersion of the cool air, falling a little short from realizing an even distribution of the cool air in the whole fresh food compartment 23.

DISCLOSURE OF INVENTION

Accordingly, the object of the present invention is to provide a refrigerator in which an even refrigeration in a fresh food compartment is realized by an even discharge of a cool air from an evaporator in the left, right, up and down directions, and in which it is possible to concentrate all the cool air into a specific region should a need arise.

The object, according to the present invention, is realized by a refrigerator including a main body housing a fresh food compartment, and a cool air duct provided in a wall of the fresh food compartment and having cool air discharging openings opened toward the fresh food compartment to supply a cool air from an evaporator into the fresh food compartment, the refrigerator comprising a rotary shaft; a driving means for rotating the rotary shaft; and cool air dispersing wings mounted spirally on the rotary shaft near the cool air discharging openings to deviate the discharge angle of the cool air blown into the fresh food compartment through the cool air discharging openings.

Here, it is preferred that the spiral cool air dispersing wings forms a double spiral structure. Desirably, the cool air discharging openings are disposed in a line with a predetermined space between each other, and the cool air dispersing wings are disposed in correspondence to the cool air discharging openings. In order to effectively deliver the cool air in the rear corner regions of the fresh food compartment, the cool air dispersing wings may protrude from a inner wall of the fresh food compartment toward the interior of the fresh food compartment. In the case, there may be advantageously provided a cool air grill of a partially cylindrical shape which is formed with the cool air discharging openings, being disposed along the rotary shaft.

BRIEF DESCRIPTION OF DRAWINGS

The present invention will be better understood and its various objects and advantages will be more fully appreciated from the following description taken in conjunction with the accompanying drawings in which.

BEST MODE FOR CARRYING OUT THE INVENTION

Hereinafter, the present invention will be described in detail with reference to the drawings.

Figure 1:
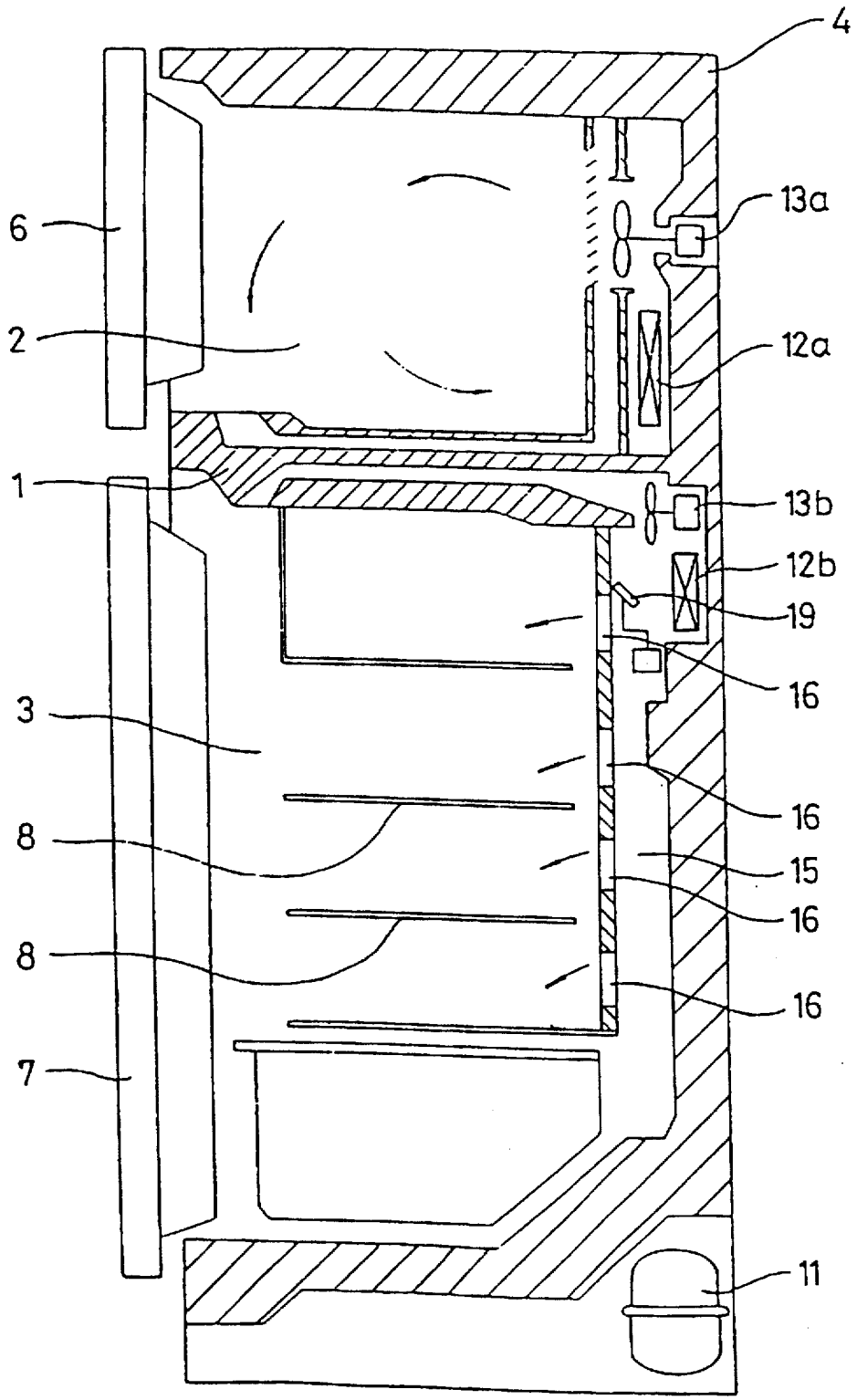
FIG. 1(PRIOR ART)
FIG. 1 is a side cross-sectional view of a typical refrigerator.
Figure 2:
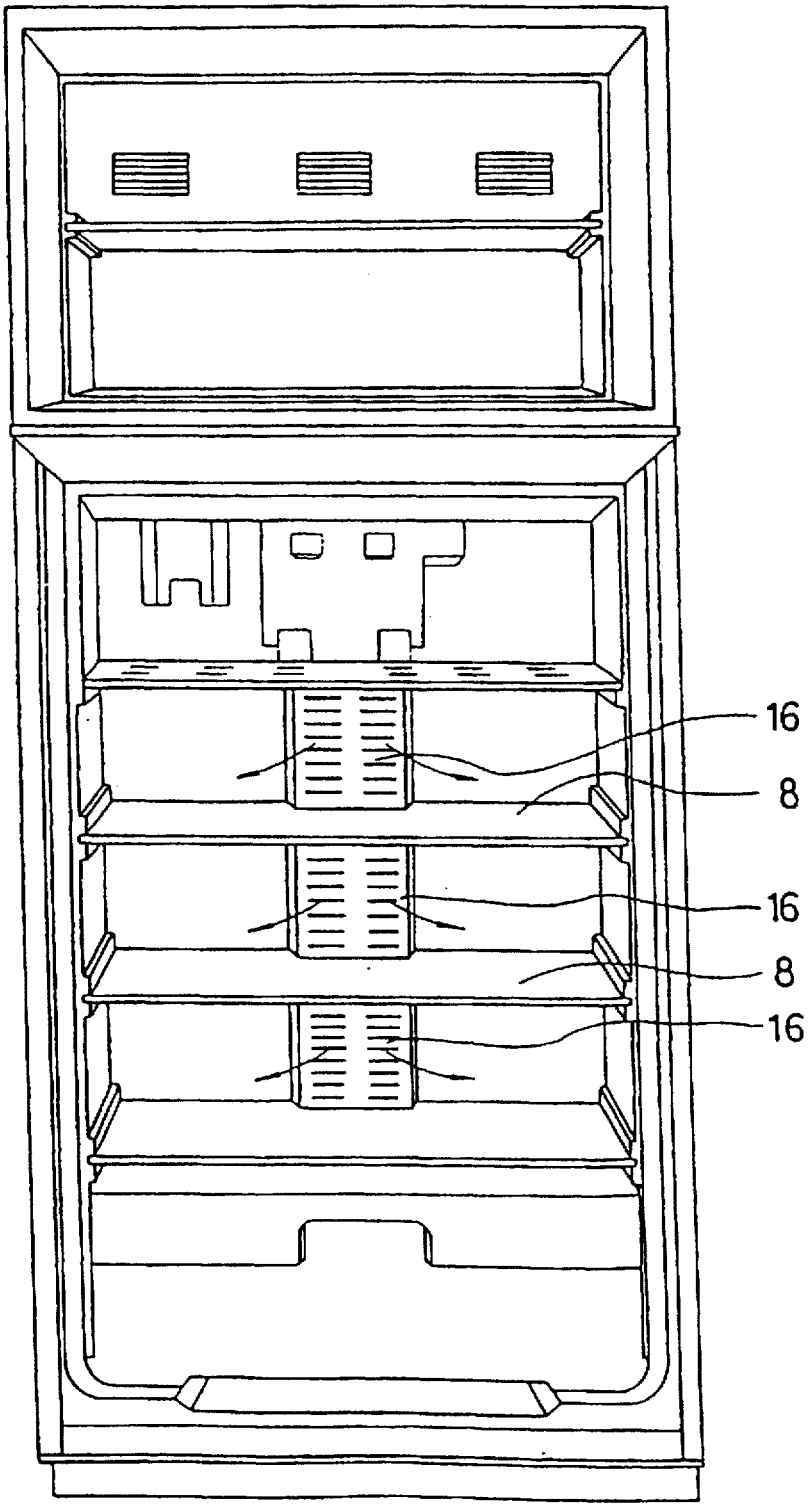
FIG. 2(PRIOR ART)
FIG. 2 is a front view of the inside of the refrigerator adopting a shelf-by-shelf cooling method.
Figure 3:
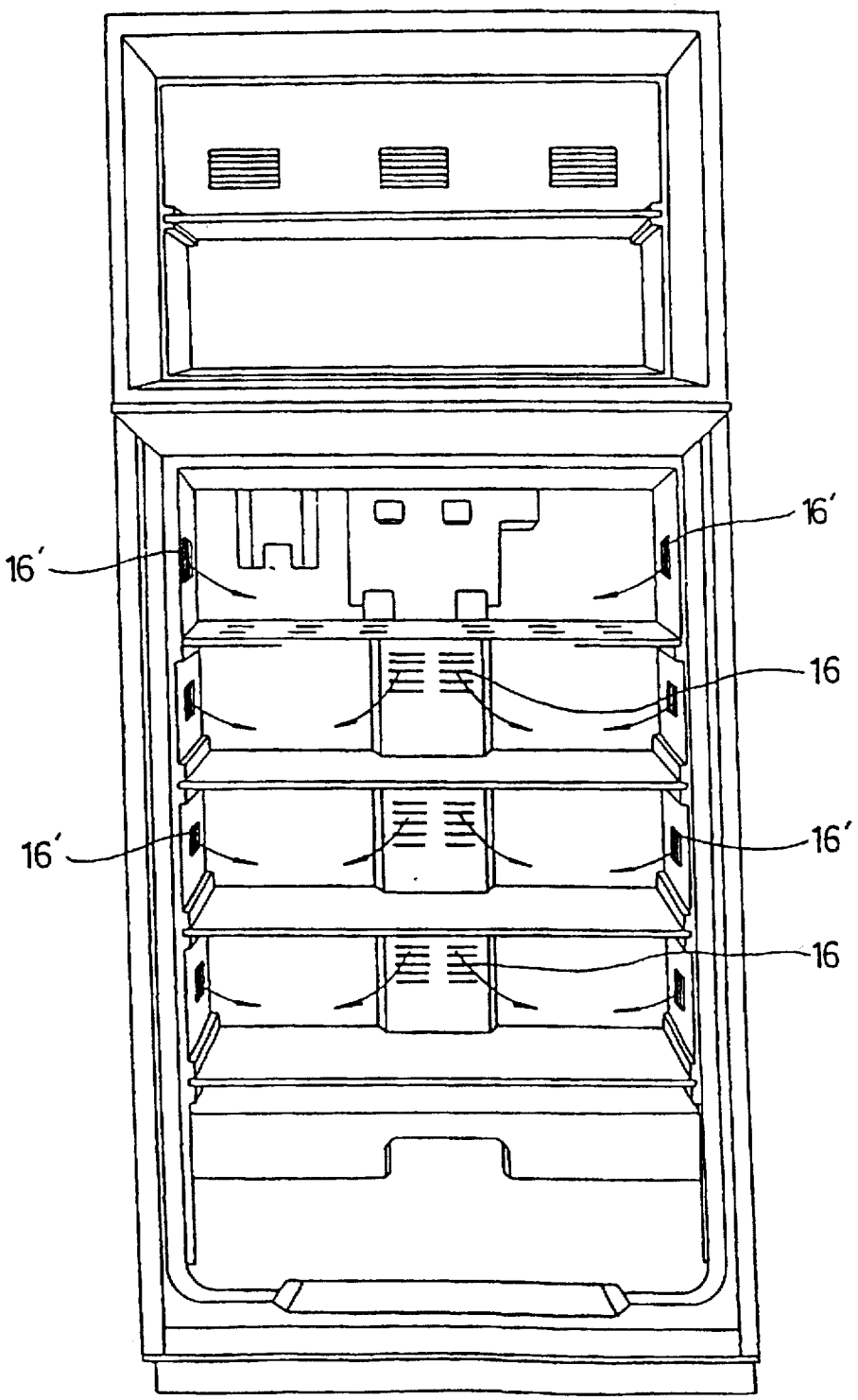
FIG. 3(PRIOR ART)
FIG. 3 is a front view of the inside of another conventional refrigerator adopting a tri-dimensional cooling method.
Figure 4:
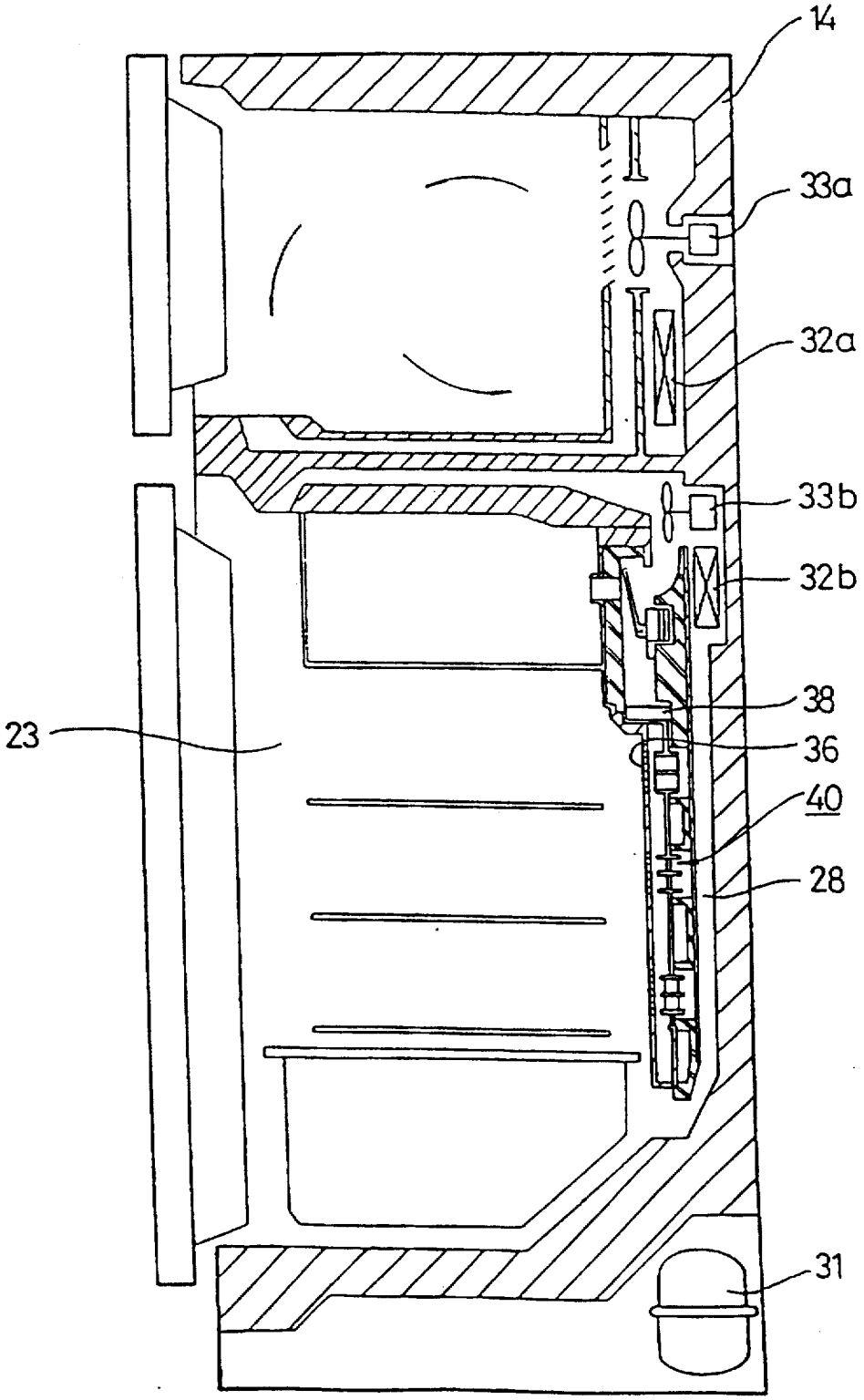
FIG. 4(PRIOR ART)
FIG. 4 is a side cross-sectional view of yet another refrigerator provided with a cool air dispersing device.
Figure 5:
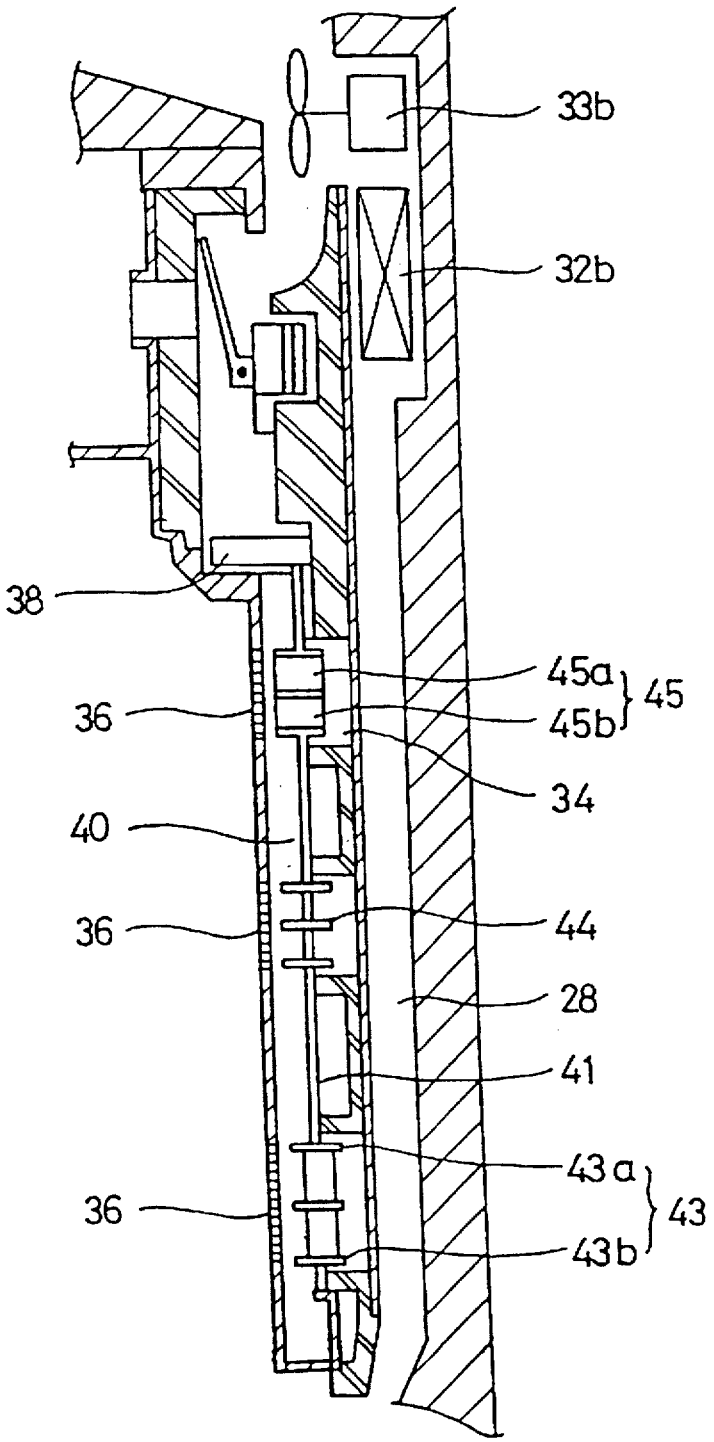
FIG. 5(PRIOR ART)
FIG. 5 is a partially enlarged view of FIG. 4.
Figure 6:
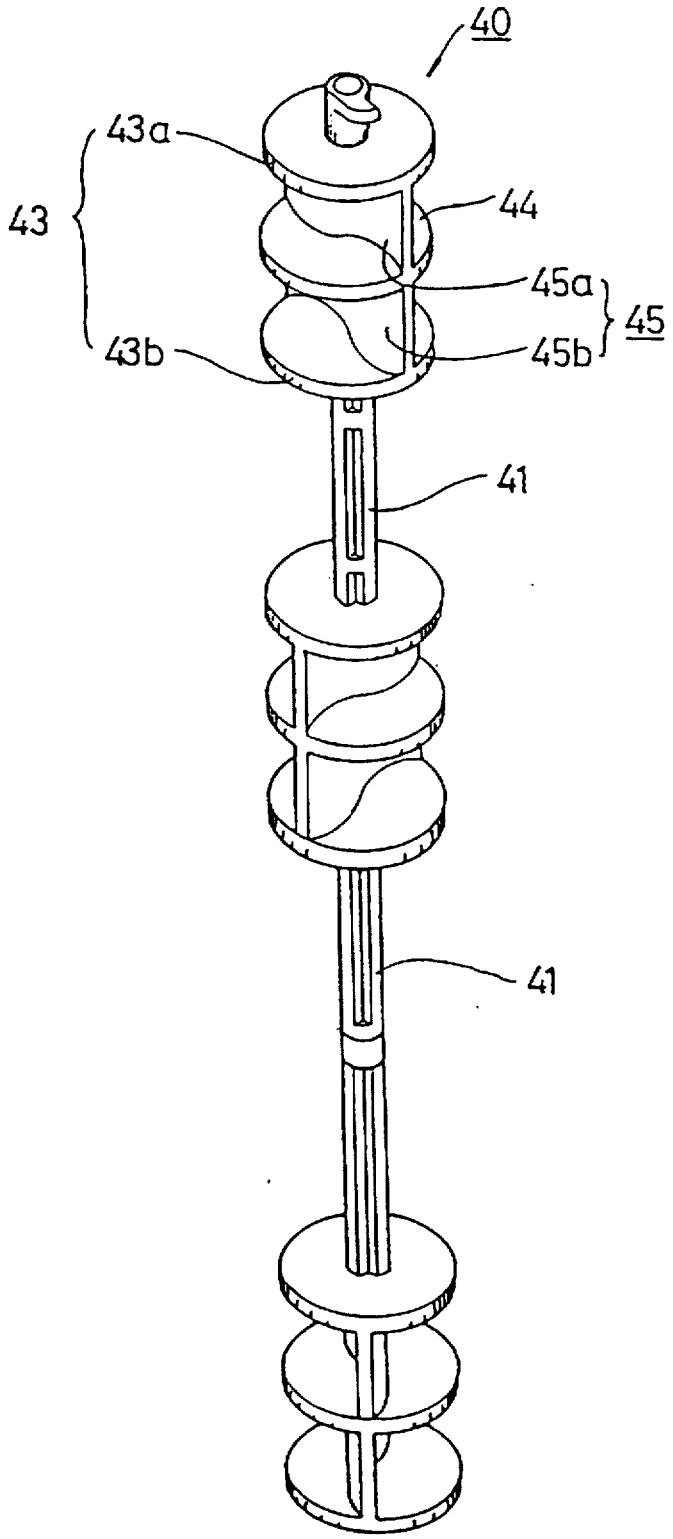
FIG. 6(PRIOR ART)
FIG. 6 is an enlarged perspective view of the cool air dispersing device of FIG. 5.
Figure 7:
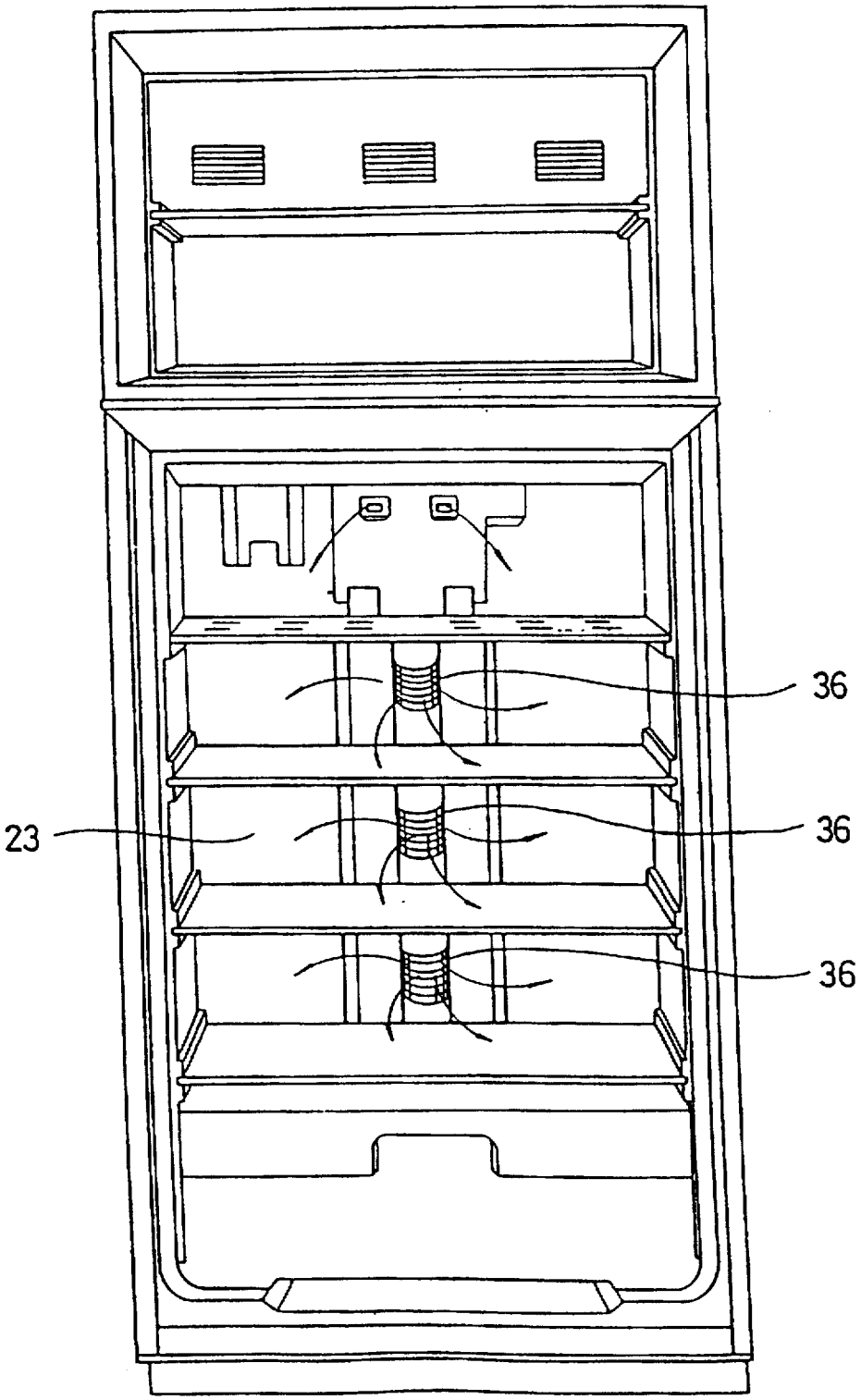
FIG. 7(PRIOR ART)
FIG. 7 is a front view of the refrigerator in FIG. 4.
Figure 8:
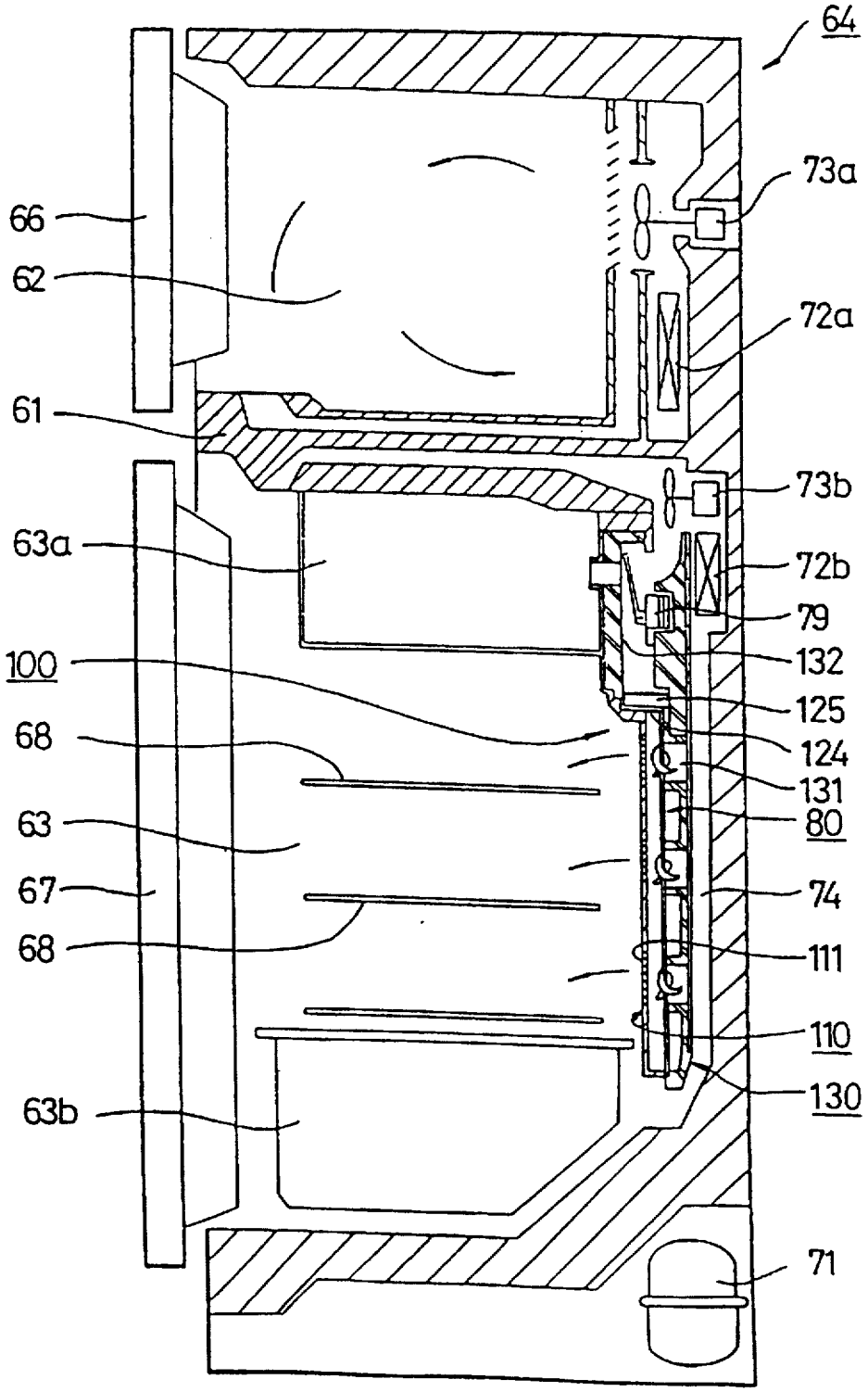
FIG. 8 is a side cross-sectional view of a refrigerator equipped with a cool air dispersing device according to the present invention.

FIG. 8 is a side cross-sectional view of a refrigerator equipped with a cool air dispersing device according to the present invention. As illustrated, the refrigerator according to the present invention, as in conventional refrigerators, has a thermally insulated main body 64 housing a freezing compartment 62 and a fresh food compartment 3 separated with each other by a partitioning wall 61, as well as a freezing compartment door 66 and a fresh food compartment door 67 which open/close the freezing compartment 62 and the fresh food compartment 63 respectively.

In the fresh food compartment 62 are disposed a plurality of shelves 68 which stratify the compartment 63 into several storage areas. A special sub-compartment 63*a* is disposed at the upper region of the fresh food compartment 63 for foodstuffs which require to be stored in a specific temperature. At the bottom of the fresh food compartment 63 is located a vegetables compartment 63*b* for storing vegetables.

In the main body 64 of the refrigerator is installed a compressor 71, a condenser(not shown) as well as a freezing compartment evaporator 72a and a fresh food compartment evaporator 72b which together perform a refrigeration cycle. The cool air is produced at each evaporator 72a, 72b. Directly above each evaporator 72a, 72b are disposed a fan 73a for the freezing compartment 62 and a fan 73b for the fresh food compartment 63 which forcefully blow the cool air produced at the evaporators 72a, 72b into the fresh food compartment 63 or the freezing compartment 62.

In the rear wall of the fresh food compartment 63 is provided a cool air duct 131 in which is disposed a cool air dispersing device 80. The cool air blown into the cool air duct 131 by the fan 73b of the fresh food compartment 63 is further delivered into the fresh food compartment 63 via the cool air dispersing device 80. In the rear of the cool air duct 131 is disposed a circulation duct 74 connecting the fresh food compartment 63 and the fresh food compartment evaporator 72b in such a way that the circulation duct 74 is isolated from the cool air duct 131. The cool air, after cooling the fresh food compartment 63, is returned to the fresh food compartment evaporator 72b via the above circulation duct 74.

Figure 9:
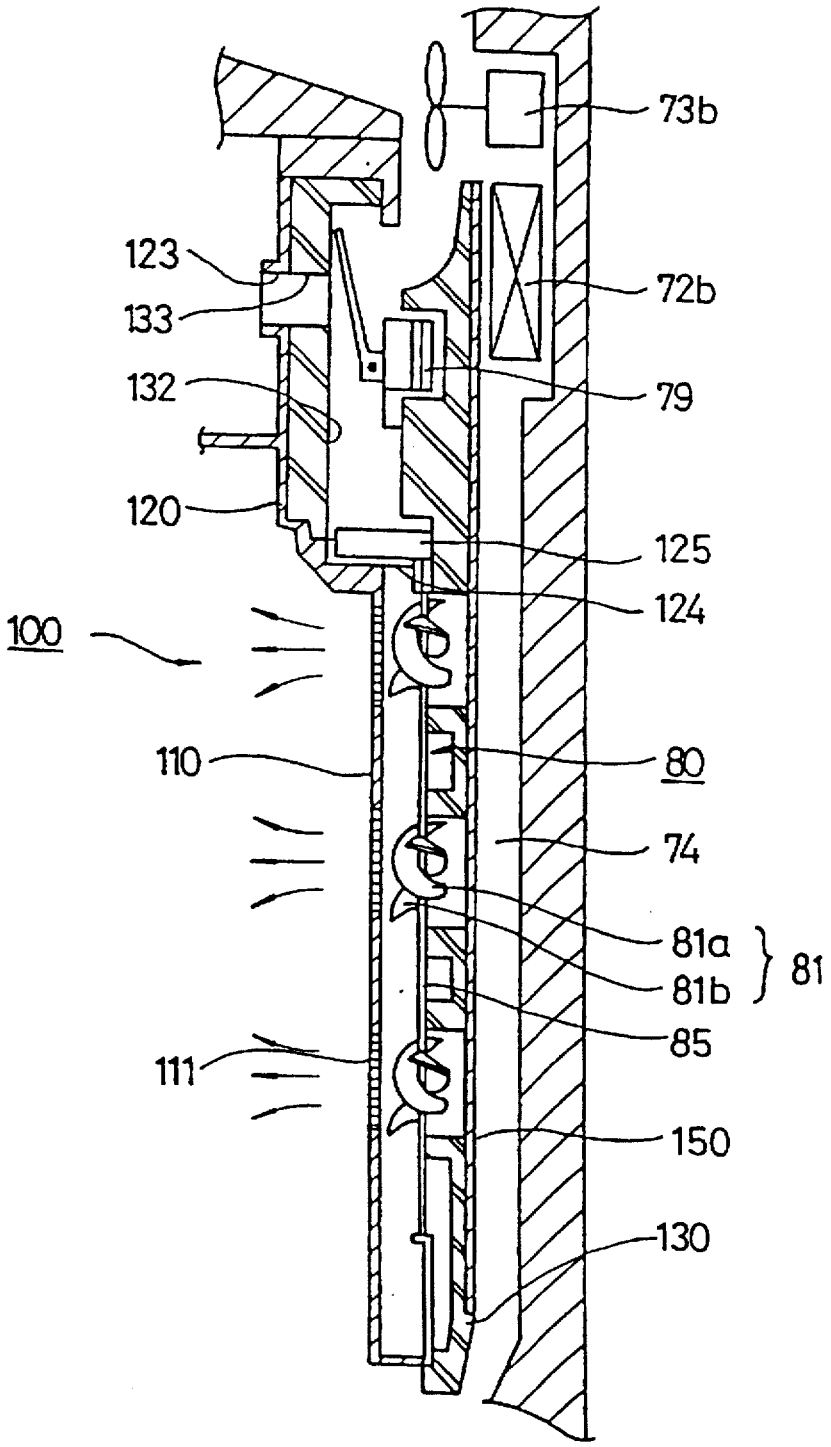
FIG. 9 is a partially enlarged perspective view of FIG. 8.
Figure 10:
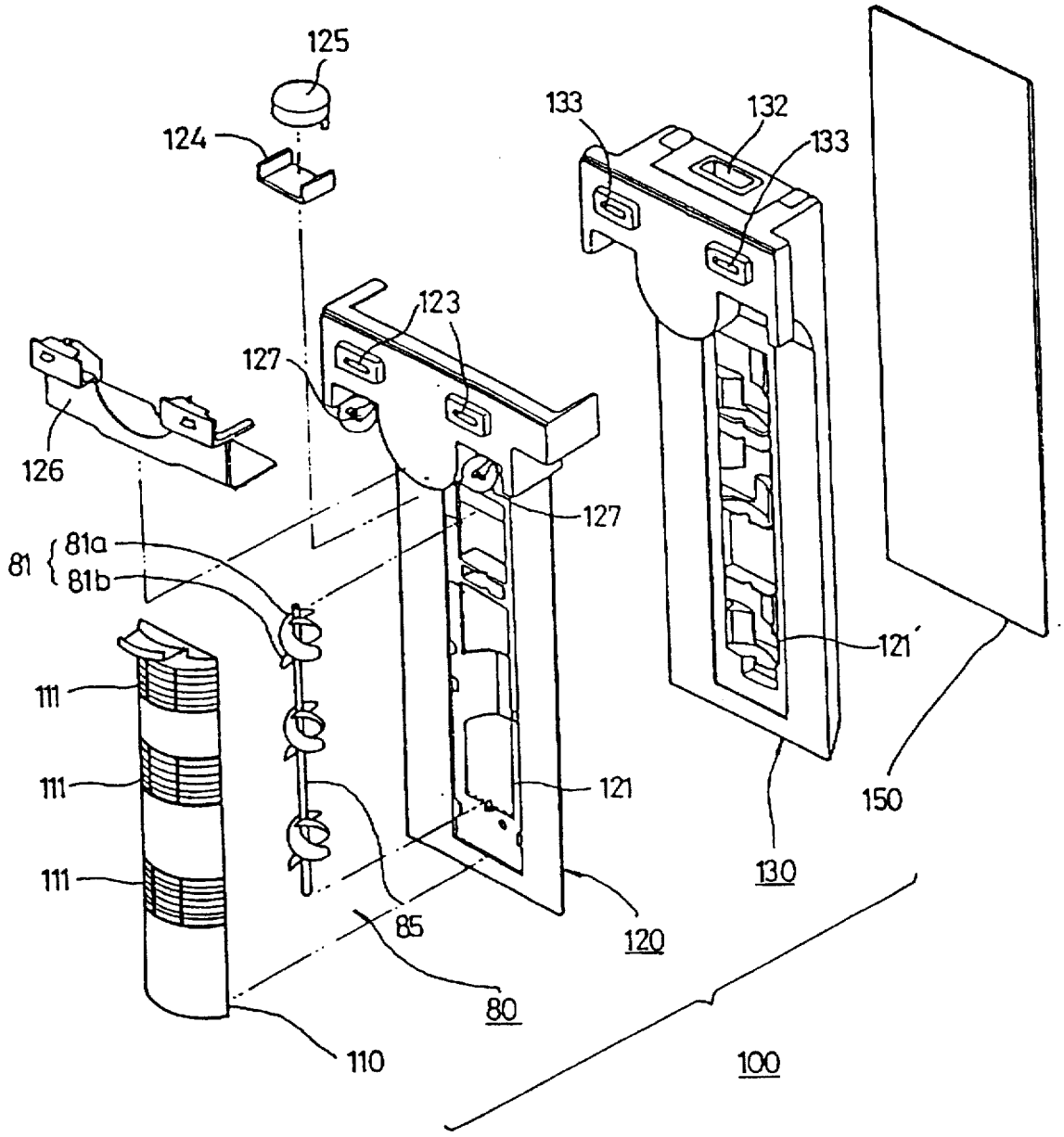
FIG. 10 is an exploded perspective view of FIG. 9.

FIG. 9 is an enlarged side cross-sectional view of the duct housing 100 which is installed in the rear wall of the fresh food compartment 63 and constitutes the cool air duct 131. FIG. 10 is an exploded perspective view of FIG. 9. The duct housing 100 forming the cool air duct 131 is comprised of a duct member 130 which guides insulatedly the cool air, a frontal panel 120 which covers up the front side of the duct member 130, a seal panel 150 which covers up the rear side of the duct member 130 and a partially cylindrical cool air grill member 110 which surrounds the cool air dispersing device 80 at the front side of the frontal panel 120. In the cool air grill member 110 are formed the cool air discharging openings 111 facing the fresh food compartment 63. The cool air dispersing device 80 is rotatably installed on the frontal panel 120. The frontal panel 120 and the duct member 130 are formed with recesses 121, 121' for accommodating a portion of the cool air dispersing device 80 to surround the cool air device 80 in cooperation with the cool air grill member 110.

The cool air dispersing device 80 is comprised of a vertically disposed rotary shaft 85, and spiral cool air dispersing wings 81 which are disposed along the shaft 85 at locations corresponding to the cool air discharging openings 111. The device 80 is put into rotation by means of a driving motor 125 housed in a motor case 124 located in the upper part of the frontal panel 120. It is desirable that the driving motor 125 is of a stepping motor to allow angle-controlled stops and reverse rotation. At each side of the driving motor 125 is disposed a lamp 127 for the purpose of illumination which is switched on and off according to the open/closed state of the fresh food compartment door 67. A lamp cover 126 houses each lamp 127.

The cool air grill member 110 is installed at the recess 121, 121' of the frontal panel 120. The cool air discharging openings 111 on the grill member 110 are disposed in such a way as to correspond to the positions of the cool air dispersing wings 81 of the cool air dispersing device 80. The frontal panel 120 is installed virtually conforming with the inner surface of the rear wall of the fresh food compartment 63, and the cool air grill member 110 is installed in such a way as to protrude from the frontal panel 120 out to the inside of the fresh food compartment 63. Accordingly, the grill member 110 and the cool air dispersing device 80 as a whole protrude somewhat from the rear wall surface of the fresh food compartment 63; this allows the cool air delivered by the cool air dispersing device 80 to be distributed in the compartment 63 in a wide angle.

In the upper part of the duct member 130 is disposed a conducting path 132 into which the cool air produced at the evaporator 72b is directed. Inside this conducting path 132 is installed a control damper 79 which regulates the amount of cool air flowing into the path 132 by opening/closing this path 132. At the upper portion of the duct member 130 is located cool air vents 133 for the special sub-compartment 63a, extending out of the conducting path 132 into the front surface of the duct member 130. The cool air vents 133 communicate with cool air discharging openings 123 for the special sub-compartment 63a, which are disposed in the frontal panel 120. The cool air discharging openings 123 for the special sub-compartment 63a face and provide the cool air to the interior of the special sub-compartment 63a in the fresh food compartment 63.

Figure 11:
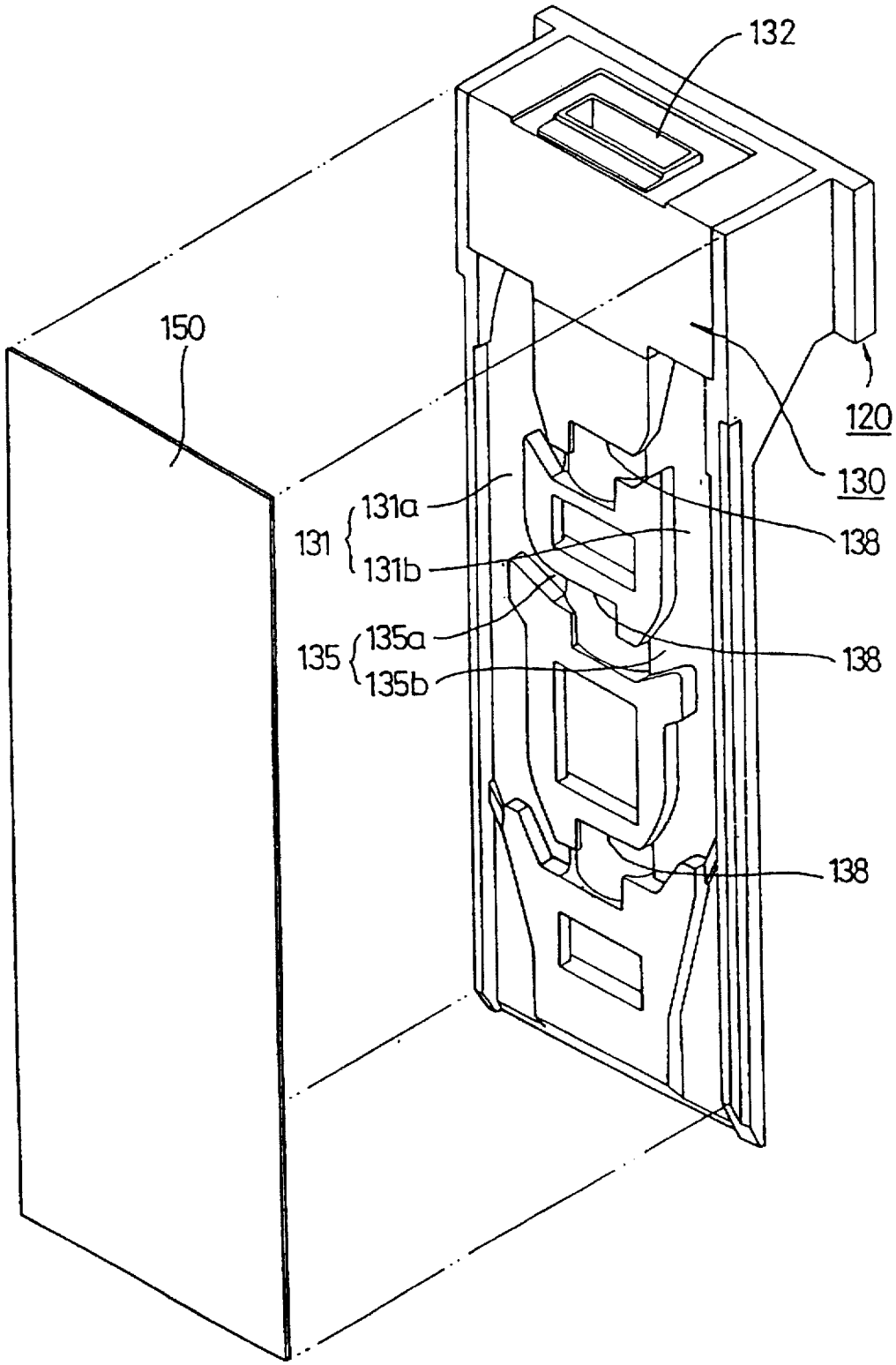
FIG. 11 is a rear perspective view of FIG. 10 showing the coupled state of a duct member and a frontal panel.

FIG. 11 is a rear perspective view of FIG. 9 showing the coupled state of the duct member 130 and the frontal panel 120. The rear surface of the duct member 130 is formed with a plurality of cool air guides 137, and between these guides 137 are disposed cool air directing vents 138 which pass through the duct member 130. The cool air directing vents 138 are positioned to correspond to the locations of the dispersing wings 81 of the cool air dispersing device 80.

The cool air ducts 131 are formed vertically at the rear surface of the duct member. The cool air guides 137 divides the cool air ducts 131 into a first duct portion 131a and a second duct portion 131b at each side thereof. The two duct portions 131a, 131b are met by the conducting path 132 at the upper end, and by the vegetables compartment 63b at the lower end.

Each duct portion 131a, 131b is directed into the cool air directing vent 138 through a first connecting channel 135a and a second connecting channel 135b which are formed between the cool air guides 137. In the illustrated embodiment, three cool air directing vents 138 are provided at the upper, middle and lower regions, and three sets of the connecting channels 135a and 135b are disposed to correspond to the positions of the cool air vents 138. Each connecting channel 135 has its upper portion rounded and its lower portion wider to the exterior than the upper portion, thereby allowing the cool air flowing down the duct portion 131 to be dispersed and directed to the connecting channels 135 in a natural fashion. The lower connecting channel is wider to the exterior and has a larger entrance than the middle connecting channel which is in turn wider than the upper connecting channel, thus allowing an even distribution of the cool air flowing into each respective cool air directing vent 138. The seal panel 150 is attached airtight to the duct member 130, and forms the rear wall of the cool air duct 131. The duct member 130 and the seal panel 150 are made out of insulating materials such as polystyrene foam and minimize the heat transfer loss of the cool air.

Figure 12:
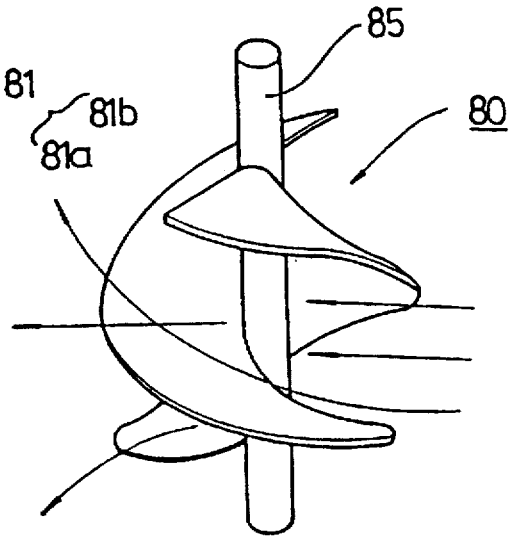
FIG. 12 is a partially enlarged perspective view of the cool air dispersing device.

FIG. 12 is a partially enlarged perspective view of a cool air dispersing wing pair 81 of the cool air dispersing device 80. The cool air dispersing device 80 is comprised of a rotary shaft 85 and three sets of cool air dispersing wing pairs 81. The cool air dispersing wing pairs 81 are disposed along the rotary shaft 85, and are separated from each other by a predetermined space. Each cool air dispersing wing pair 81 comprises a first wing 81a and a second wing 81b. The first and second wings 81a, 81b are each formed around the shaft 85 in a spiral and extend along the shaft 85 for a predetermined distance. The cool air dispersing wing pair 81 therefore realize a double-spiral structure.

In such an arrangement, the cool air conducted from the cool air vent 138 to the cool air dispersing device 80, is delivered evenly to the fresh food compartment by being dispersed, up-down and left-right depending on the angle of collision between the cool air and the wing surface. Moreover, there exits also a portion of the cool air blowing out in a straight direction without hitting any wing surface as there is room between the first wing 81*a* and the second wing 81*b*. Furthermore, the angle at which the cool air is discharged into the fresh food compartment is dependent upon the angular position of the rotary shaft 85, which means that as the driving motor 125 rotates the shaft, the cool air is dispersed evenly to all directions(left, right, up and down); and the cool air can be concentrated to one single specific direction by stopping the rotary shaft 85 from rotating.

Figure 13:
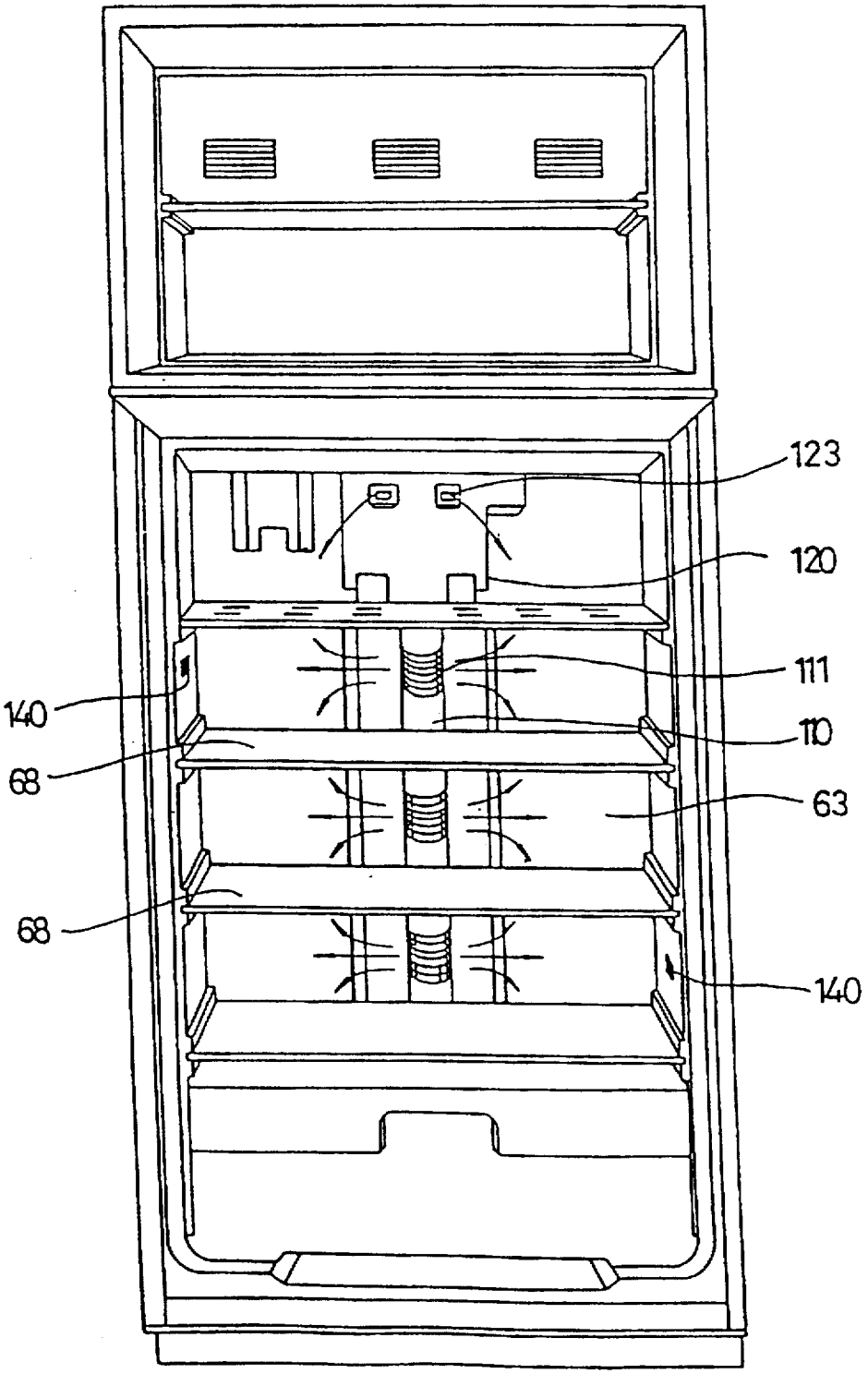
FIG. 13 is a front view of the refrigerator in FIG. 8 showing its interior.

Inside the fresh food compartment 63, as illustrated in FIG. 13, are disposed a plurality of temperature sensors 140. The refrigerator senses the temperature of the fresh food compartment 63 through these sensors 140 and if the temperature in the compartment 63 is not appropriate to the refrigeration power level desired by the user, the compressor 71 is activated and the refrigeration operation is put into effect. Accordingly, the cool air produced in the fresh food compartment evaporator 72*b* passes through the control damper 79 and then to the conducting path 132; the cool air is then dispersed to the left and to the right by the cool air guides 137. The cool air is drained down, and discharged into the fresh food compartment 63 and the vegetables compartment 63*b* via the first and the second duct portions 131*a* and 131*b*. A portion of the cool air is blown into the special sub-compartment 63*a* through the cool air vents 133 and through the cool air discharging openings 123.

In order to achieve an uniform distribution of the cool air in the fresh food compartment 63, the cool air dispersing device 80 rotates by means of a driving motor 125, and the cool air provided thereat flows according to the sloped surfaces of each spiral wings 81*a*, 81*b* and is dispersed to all directions(left, right, up and down) in the fresh food compartment 63 as illustrated in FIG. 13. As a result, a uniform temperature is achieved within the fresh food compartment 63 eliminating regions that are normally deprived of cool air.

The cool air dispersing device 80 can change the direction of its cool air discharge by shifting its angular position of its rotation. An uniform distribution of cool air in all directions is realized thanks to the continuously changing angle of discharge of the cool air created by the slowly rotating cool air dispersing device 80 powered by a driving motor 125. Furthermore, as the temperature of a specific region within the fresh food compartment 63 goes up for such reasons as storing a hot item, the driving motor 125 can lock the discharge angle of the cool air dispersing device 80, in order to concentrate all the cool air in that particular direction and effectuate a concentrated refrigeration of the region.

INDUSTRIAL APPLICABILITY

As explained above, according to the present invention, a refrigerator with a cool air dispersing device having spiral wings which provide a uniform refrigeration in all four directions(left, right, up and down) and which can also realize a concentrated refrigeration of a specific region by means of a controllable angle of discharge, is provided.

What is claimed is:

1. A refrigerator including a main body housing a fresh food compartment, and a cool air duct provided in a wall of the fresh food compartment and having cool air discharging openings opened toward the fresh food compartment to supply a cool air from an evaporator into the fresh food compartment, the refrigerator comprising:

a fan to circulate air over the evaporator and blow cooled air into the fresh food compartment through the cool air discharge openings;

a rotary shaft;

a driving means for rotating said rotary shaft; and cool air dispersing wings mounted spirally on said rotary shaft near said cool air discharging openings to deviate the discharge angle of the cool air blown into the fresh food compartment through the cool air discharging openings.

2. The refrigerator in claim 1, wherein said spiral cool air dispersing wings forms a double spiral structure.

3. The refrigerator in claim 1, wherein said cool air discharging openings are disposed in a line with a predetermined space between each other, and said cool air dispersing wings are disposed in correspondence to said cool air discharging openings.

4. The refrigerator in claim 3, wherein said cool air dispersing wings protrude from a inner wall of said fresh food compartment toward the interior of said fresh food compartment.

5. The refrigerator in claim 4, further comprising a cool air grill of a partially cylindrical shape which is formed with said cool air discharging openings, said cool air grill being disposed along said rotary shaft.

* * * * *